US007053859B2

(12) United States Patent
Jackson et al.

(10) Patent No.: US 7,053,859 B2
(45) Date of Patent: May 30, 2006

(54) SUPPORT STRUCTURE FOR ANTENNAS, TRANSCEIVER APPARATUS AND ROTARY COUPLING

(75) Inventors: Timothy Jackson, Cambridge (GB); Esen Bayar, London (GB); Stephen Field, Haverhill (GB)

(73) Assignee: Radiant Networks PLC, Essex (GB)

( * ) Notice: Subject to any disclaimer, the term of this patent is extended or adjusted under 35 U.S.C. 154(b) by 0 days.

(21) Appl. No.: 10/450,192

(22) PCT Filed: Dec. 19, 2001

(86) PCT No.: PCT/GB01/05662

§ 371 (c)(1),
(2), (4) Date: Oct. 21, 2003

(87) PCT Pub. No.: WO02/50950

PCT Pub. Date: Jun. 27, 2002

(65) Prior Publication Data

US 2004/0113861 A1 Jun. 17, 2004

(30) Foreign Application Priority Data

Dec. 19, 2000 (GB) ..... 0030931.0

(51) Int. Cl.
*H01Q 3/02* (2006.01)

(52) U.S. Cl. ..... 343/882

(58) Field of Classification Search ..... 343/882, 343/790, 791, 772, 776, 880, 881, 869; 455/700
See application file for complete search history.

(56) References Cited

U.S. PATENT DOCUMENTS

| | | | | |
|---|---|---|---|---|
| 4,379,297 | A * | 4/1983 | Chevallier | 343/882 |
| 4,450,450 | A | 5/1984 | Ellingson et al. | 343/758 |
| 4,468,671 | A | 8/1984 | Ellingson et al. | 343/766 |
| 4,470,050 | A | 9/1984 | Ellingson et al. | 343/766 |
| 4,473,827 | A | 9/1984 | Ellingson et al. | 343/766 |
| 4,512,448 | A * | 4/1985 | Estang | 188/378 |
| 5,065,969 | A | 11/1991 | McLean | 248/282.1 |
| 5,281,975 | A * | 1/1994 | Hugo | 343/766 |
| 5,432,524 | A | 7/1995 | Sydor | 343/765 |
| 5,619,215 | A | 4/1997 | Sydor | 343/766 |
| 5,641,141 | A | 6/1997 | Goodwin | 248/218.4 |
| 5,920,291 | A * | 7/1999 | Bosley | 343/892 |
| 6,111,542 | A | 8/2000 | Day et al. | 342/354 |
| 6,217,390 | B1 * | 4/2001 | Casari | 439/651 |
| 6,243,046 | B1 | 6/2001 | Aoki | 343/765 |
| 6,768,474 | B1 * | 7/2004 | Hunt | 343/892 |

FOREIGN PATENT DOCUMENTS

| | | |
|---|---|---|
| WO | WO 94/26001 | 11/1994 |
| WO | WO 98/49750 | 11/1998 |
| WO | WO 98/53522 | 11/1998 |
| WO | WO 99/65162 | 12/1999 |

* cited by examiner

*Primary Examiner*—Trinh Vo Dinh
*Assistant Examiner*—Huedung X. Cao
(74) *Attorney, Agent, or Firm*—Pillsbury Winthrop Shaw Pittman LLP

(57) ABSTRACT

A support structure (10) for supporting a plurality of antennas (11) has a plurality of antenna supports (13) each for supporting at least one antenna (11). Each antenna support (13) is supported for rotation about an axis of rotation. At least one antenna support (13) is selectively rotatable with respect to the or each other antenna support (13) such that an antenna (11) supported by said at least one antenna support (13) rotates therewith.

13 Claims, 12 Drawing Sheets

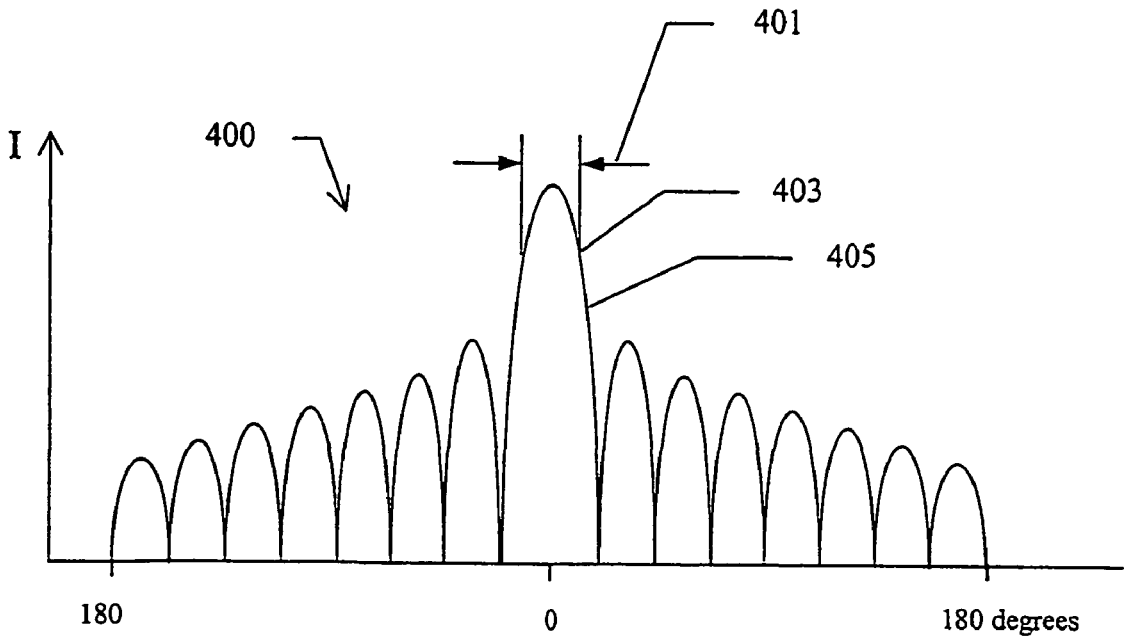
Figure 12A: Elevation Beamwidth
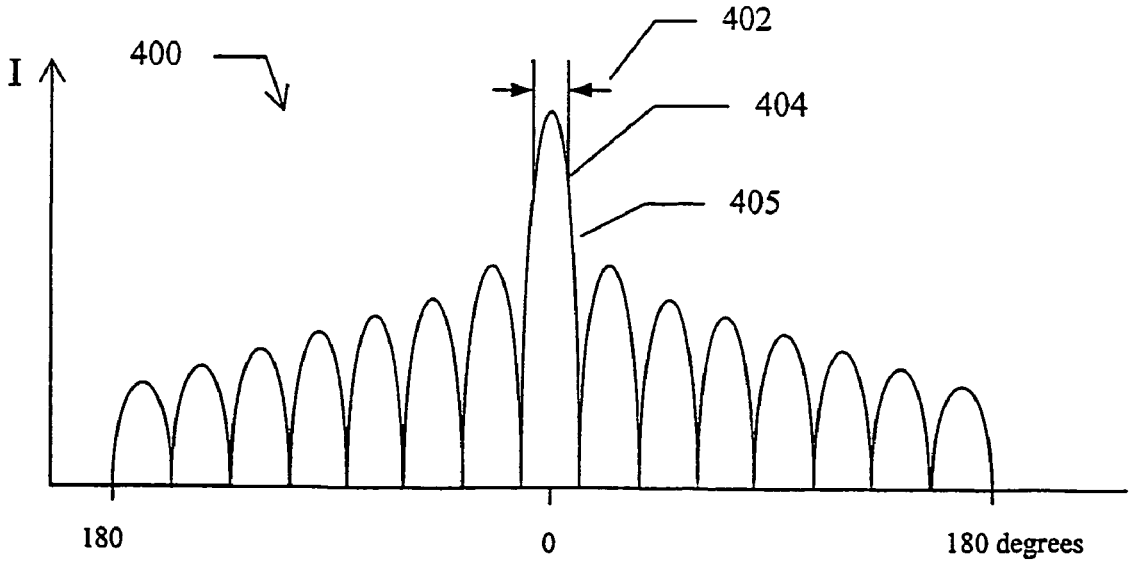
Figure 12B: Azimuth Beamwidth

SUPPORT STRUCTURE FOR ANTENNAS, TRANSCEIVER APPARATUS AND ROTARY COUPLING

This application is the National Phase of International Application PCT/GB01/05662 filed Dec. 19, 2001 which designated the U.S. and that International Application was published in English under PCT Article 21(2) on Jun. 27, 2002 as International Publication Number WO 02/50950 A1. PCT/GB0/05662 claims priority to British Application No. 0030931.0, filed Dec. 19, 2000. The entire contents of these applications are incorporated herein by reference.

The present invention relates to a support structure for antennas, transceiver apparatus and a rotary coupling.

Wireless communications offers many attractive features in comparison with wired communications. For example, a wireless system is very much cheaper to install as no mechanical digging or laying of cables or wires is required and user sites can be installed and de-installed very quickly.

It is a feature of wireless systems when a large bandwidth (data transfer rate) is required that, as the bandwidth which can be given to each user increases, it is necessary for the bandwidth of the wireless signals to be similarly increased. Furthermore, the frequencies which can be used for wireless transmission are closely regulated. It is a fact that only at microwave frequencies (i.e. in the gigahertz (GHz) region) or higher are such large bandwidths now available as the lower radio frequencies have already been allocated.

A problem with microwave or higher frequencies is that these radio frequencies are increasingly attenuated or completely blocked by obstructions such as buildings, vehicles, trees, etc. Such obstructions do not significantly attenuate signals in the megahertz (MHz) band but becomes a serious problem in the gigahertz (GHz) band. Thus, conventional wisdom has been that microwave or higher frequencies are difficult to use in a public access network which provides communication with a large number of distributed users.

The spectral efficiency of any wireless communications system is extremely important as there are many demands on radio bandwidth. As a matter of practice, the regulatory and licensing authorities are only able to license relatively narrow regions of the radio spectrum.

A cellular system, which uses point-to-multipoint broadcasts, places high demands on the radio spectrum in order to provide users with a satisfactory bandwidth and is therefore not very efficient spectrally.

The use of repeaters or relays in such systems to pass on data from one station to another is well known in many applications. In general, such repeaters broadcast signals, in a point-to-multipoint manner, and are therefore similar to a cellular approach and suffer from a corresponding lack of spectral efficiency.

A "mesh" communications system, which uses a multiplicity of point-to-point wireless transmissions, can make more efficient use of the radio spectrum than a cellular system. An example of a mesh communications system is disclosed in our International patent application WO-A-98/27694, the entire disclosure of which is incorporated herein by reference. In a typical implementation of a mesh communications system, a plurality of nodes are interconnected using a plurality of point-to-point wireless links. Each node is typically stationary or fixed and the node is likely to contain equipment that is used to connect a subscriber or user to the system. Each node has apparatus for transmitting and for receiving wireless signals over the plurality of point-to-point wireless links and is arranged to relay data if data received by said node includes data for another node. At least some, more preferably most, and in some cases all, nodes in the fully established mesh of interconnected nodes will each be associated with a subscriber, which may be a natural person or an organisation such as a company, university, etc. Each subscriber node will typically act as the end point of a link dedicated to that subscriber (i.e. as a source and as a sink of data traffic) and also as an integral part of the distribution network for carrying data intended for other nodes. The non-subscriber nodes may be provided and operated by the system operator in order to provide for better geographical coverage to subscribers to the system. The frequency used may be for example at least about 1 GHz. A frequency greater than 2.4 GHZ or 4 GHz may be used. Indeed, a frequency of 28 GHz, 40 GHz, 60 GHz or even 200 GHz may be used. Beyond radio frequencies, other yet higher frequencies such as of the order of 100,000 GHz (infra-red) could be used.

Within a mesh communications system, each node is connected to one or more neighbouring nodes by separate point-to-point wireless transmission links. When combined with the relay function in each node, it becomes possible to route information through the mesh by various routes. Information is transmitted around the system in a series of "hops" from node to node from the source to the destination. By suitable choice of node interconnections it is possible to configure the mesh to provide multiple alternative routes, thus providing improved availability of service.

A mesh communications system can make more efficient use of the spectrum by directing the point-to-point wireless transmissions along the direct line-of-sight between the nodes, for example by using highly directional beams. This use of spatially directed transmissions reduces the level of unwanted transmissions in other spatial regions and also provides significant directional gain such that the use of spatially directed transmissions as a link between nodes allows the link to operate over a longer range than is possible with a less directional beam. By contrast, a cellular system is obliged to transmit over a wide spatial region in order to support the point-to-multipoint transmissions. This is typically achieved in a cellular system by having a base station of the cellular system transmit a beam which has a very wide beam width in azimuth (typically being a sector of 60 degrees, 120 degrees or omnidirectional) but which has a narrower beam width in elevation, i.e. the beam from a base station in a cellular system is typically relatively horizontally flat and wide.

In addition to the improved spectral efficiency, a mesh communications system can benefit from improved performance by using high gain antennas to direct the point-to-point wireless transmissions, thereby improving the quality of such transmissions. Furthermore, the mesh topology can provide improved coverage because the direction of the various wireless links can be adjusted to direct the wireless transmissions around obstructions.

It is possible to consider a mesh network that is assembled by static configuration of point-to-point links, where the direction of the links is determined at the time of installation. However, an improved mesh network is possible if the nodes are capable of changing the direction of one or more of the point-to-point links. This ability to redirect and reconfigure the links can be used to support the growth and evolution of the mesh network, since it means that the nodes are capable of rearranging the point-to-point links between nodes.

In a typical mesh communications system, each node is required to support multiple point-to-point wireless links, each of the wireless links connecting the node to a respective other node. In order to support these multiple wireless links and be capable of changing the direction of one or more of the wireless links, it is preferred for the node to be able to steer the antennas that provide for the transmission and reception of the wireless transmissions along the links.

In WO-A-94/26001 there is disclosed an arrangement by which steerable antennas are provided for use in a wireless local area network. In the specific example described, three pillbox antennas are arranged one above the other and a fourth, omnidirectional antenna is placed above the three pillbox antennas. Each pillbox antenna is in essence formed in two parts, a fixed base portion and a rotatable upper or reflector portion. Each pillbox antenna has a sector type transmission/reception pattern. By virtue of the rotatable reflector portion, the direction of the sector can be moved around a horizontal plane. Significantly, it is only a part of each of the pillbox antennas that is rotated and not the whole of the respective pillbox antennas. The fixed base portions of each pillbox antenna enable feed waveguides to be passed between the pillbox antennas and the omnidirectional antenna. Because of the rotation arrangement provided for the pillbox antennas, these feed waveguides are positioned off the axes of rotation of the pillbox antennas and in particular outside the pillbox antennas. This in turn means that the feed waveguides will inevitably obstruct transmissions from or reception at the pillbox antennas for at least some orientation of the pillbox antennas.

According to a first aspect of the present invention, there is provided a support structure for supporting a plurality of antennas, the support structure comprising: a plurality of antenna supports each for supporting at least one antenna, each antenna support having first and second ends; each antenna support being supported for rotation about an axis of rotation between the first and second ends; at least one antenna support being selectively rotatable with respect to the or each other antenna support such that an antenna supported by said at least one antenna support rotates therewith.

Because in each case the whole antenna support is rotatable, an antenna mounted in the antenna support inevitably rotates therewith. In a preferred embodiment, the axis of rotation is left clear, which means that an antenna feed can simply be accommodated along the axis of rotation. This in turn simplifies the mechanical arrangement for the support structure and its components and also allows losses in the antenna feed to be minimised. Moreover, in a point-to-point system, as opposed to a sectorial or a quasi-sectorial system, the beam width that is used is as narrow as is practically realisable at the frequency of transmission. This in turn means that any physical obstructions of any significant size can have a significant negative impact on the transmitted or received beams. For example, and referring to the arrangement in WO-A-94/26001 where a waveguide obstructs the antennas at some antenna orientations, a waveguide operating at 28 GHz may be approximately 1.5 cm wide. Such an obstruction will not only completely obscure the antenna at some orientations, but it will also affect the radiation pattern at other orientations. In a communications system operating under licensed frequencies, this is typically not permissible according to international standards (such as those set by ETSI). (It is mentioned here that many wireless LANs operate at frequencies that do not have to be licensed and therefore this is typically not an issue for a wireless LAN.)

In use, the support structure will typically be vertically arranged, with one antenna support being positioned vertically above another.

At least two antenna supports are preferably arranged end-to-end such that a first end of one of said antenna supports opposes a second end of the other of said antenna supports.

Each antenna support is preferably rotatable independently of each other antenna support. In practice in a typical embodiment, when one antenna support is rotated, it will normally be necessary to rotate the antenna support immediately above that first antenna support back to its original position in order to maintain all of the antenna supports other than the one antenna support in their original positions.

A rotation device must be provided for rotating one antenna support relative to a neighbouring antenna support.

A plurality of rotation devices may be provided, each for causing rotation of a respective antenna support relative to a neighbouring antenna support.

The or each rotation device may comprise a motor fixed to one of said antenna supports and a ring gear on an adjacent antenna support that is drivingly engageable by the motor to cause rotation of one of said antenna supports relative to the other.

A first of said antenna supports may have a first end opposing a second end of an adjacent second antenna support and a bearing for the second antenna support may comprise a first annular bearing half at said first end of said first antenna support and a second annular bearing half at said second end of said second antenna support.

Each antenna support is preferably rotatable independently of each other antenna support.

A respective antenna may be mounted in each antenna support for transmitting and/or receiving wireless signals.

A respective waveguide may be provided along the axis of rotation of each antenna support for guiding electromagnetic waves between an antenna mounted in said antenna support and a transceiver.

In an embodiment, at least two neighbouring antenna supports have coincident axes of rotation, the support structure comprising a transceiver mounted in one of said neighbouring antenna supports, an antenna mounted in the other of said neighbouring antenna supports, a first waveguide and a second waveguide, the first waveguide being connected at a first end to said transceiver and at a second end to a first end of the second waveguide, the second end of the second waveguide being connected to said antenna, the connection between the first and second waveguides being a rotatable coupling that allows the first and second waveguides to rotate relative to each other as said neighbouring antenna supports rotate relative to each other, the rotatable coupling having an axis of rotation that is coincident with the axes of rotation of said neighbouring antenna supports. This arrangement enables in a simple manner the sharing of a transceiver between an antenna mounted in one of the antenna supports and the antenna mounted in the other of said neighbouring antenna supports whilst requiring only a single rotatable coupling and allowing neighbouring antenna supports to rotate independently of each other.

The support structure may comprise an external radome.

The support structure may comprise an external radome, the bearing for at least one antenna support being at least partly provided by the radome.

At least one of the antenna supports may be formed at least partly of opaque material that is opaque to the frequency of transmission of antennas supported by the support structure.

An endmost of the antenna supports may be rotatably mounted on a fixed base of the support structure, the support structure comprising a rotation device for rotating said endmost antenna support relative to the base.

Each antenna support is preferably supported by a bearing that is constructed and arranged so as to leave clear the axis of rotation of each antenna support. This allows an antenna feed, electrical wiring, etc., to be accommodated along the axis of rotation.

According to a second aspect of the present invention, there is provided transceiver apparatus, the apparatus comprising: at least two antennas, each antenna being independently rotatable about its own axis of rotation; and, at least one transceiver that is connected to each of said at least two antennas, the transceiver being rotatable about an axis of rotation independently with respect to each of said at least two antennas.

The axes of rotation of the at least two antennas and the at least one transceiver are preferably parallel or coincident.

According to a third aspect of the present invention, there is provided a rotary coupling for rotatably coupling together two waveguides, the rotary coupling comprising: a first waveguide section; a second waveguide section; a coaxial transmission section having an inner conductor and an outer conductor separated by an insulator for coupling waveguide transmissions in the first waveguide section via the coaxial transmission section to waveguide transmissions in the second waveguide section; and, a clip for holding the first waveguide and the second waveguide together whilst allowing the first waveguide to rotate independently of the second waveguide.

Such a rotary coupling has particular application in the support structures described above in connecting a waveguide in one antenna support to a waveguide in an adjacent antenna support. However, the rotary coupling may be used in other applications. The rotary coupling allows for rotation between connected waveguides and, in the preferred embodiment, allows the waveguides simply to be connected together and, if necessary, to be disconnected.

The coaxial transmission section is preferably axially symmetric.

The outer conductor of the coaxial transmission section may be provided by a nose of the first waveguide section. The clip may be received in the second waveguide section and may be arranged so that the nose of the first waveguide section can be pushed into and retained by the clip when the first and second waveguide sections are assembled together.

The clip may be generally cylindrical and comprise a plurality of resilient legs having inwardly facing projections at their free ends that are received behind the nose of the first waveguide section when the first and second waveguide sections are assembled together.

Embodiments of the present invention will now be described by way of example with reference to the accompanying drawings, in which:

FIGS. 12A and 12B show an example of a typical radiation pattern for a beam transmitted by the antenna in the mesh communications network; and, FIG. 13A and FIG. 13B show schematically a rear view and a lateral cross-sectional view of an example of an antenna.

Figure 1:
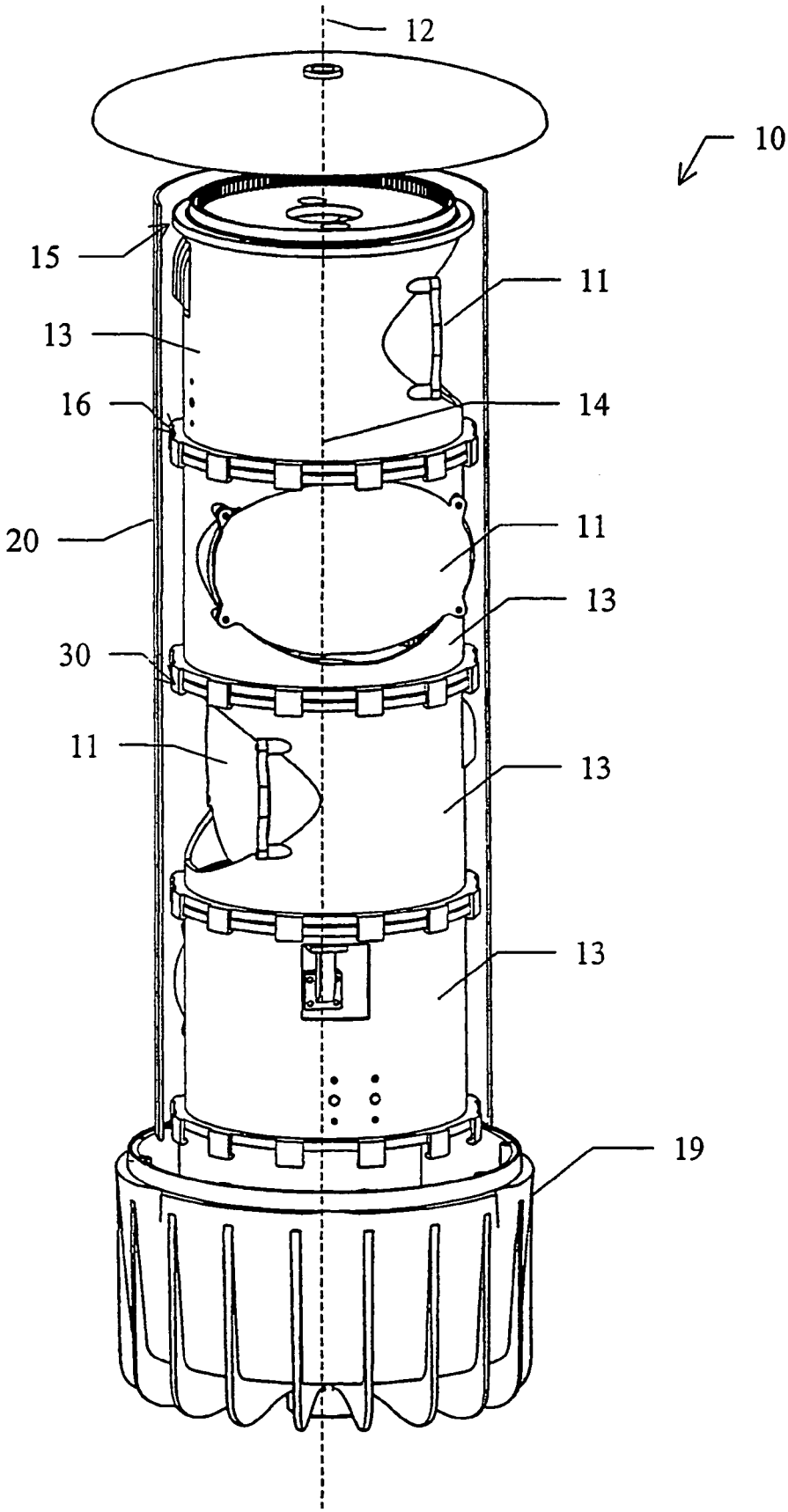
FIG. 1 is a part phantom, partly exploded, perspective view of an example of a support structure according to the present invention.
Figure 2:
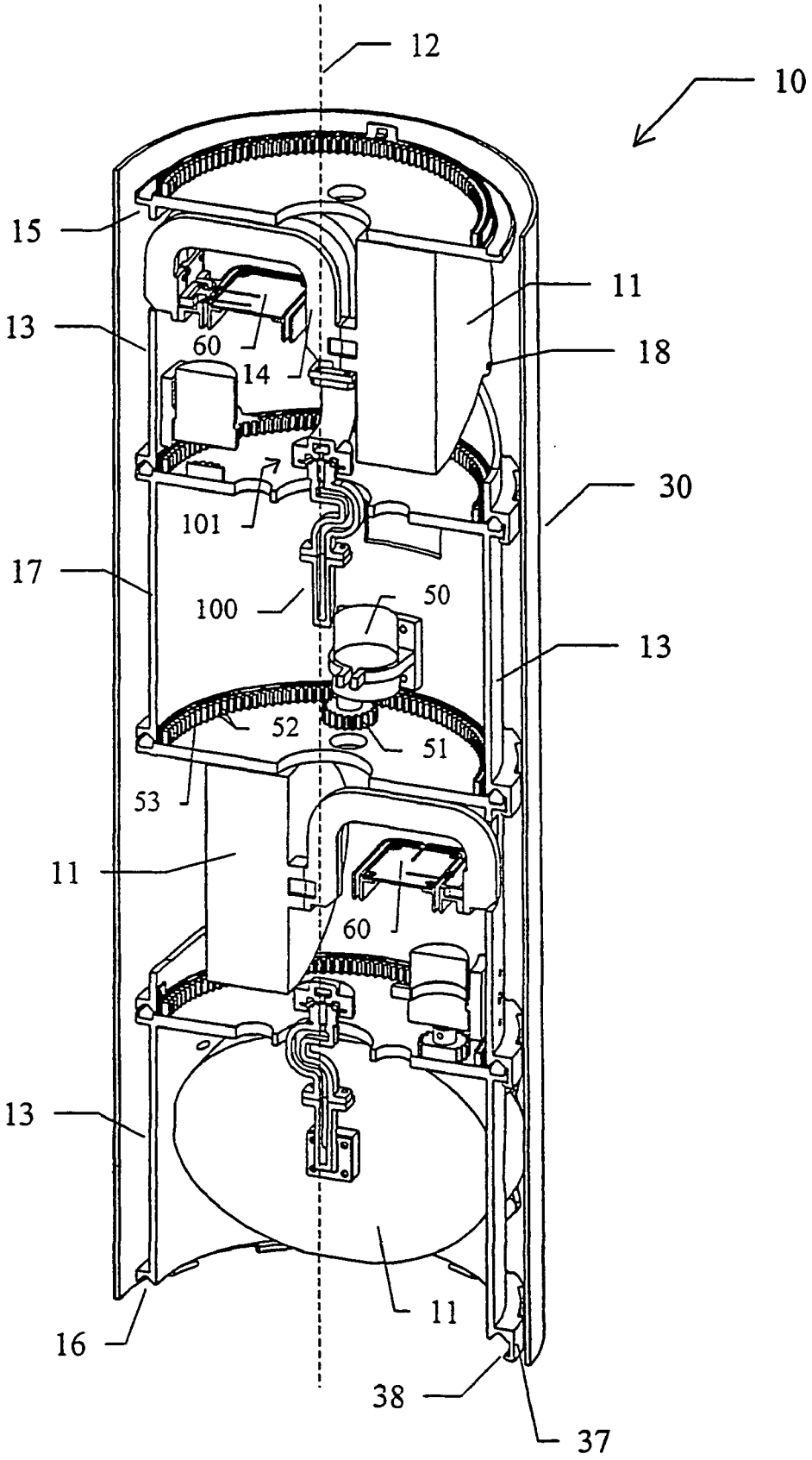
FIG. 2 is a longitudinally sectioned perspective view of the antenna supports of the support structure of FIG. 1.
Figure 3:
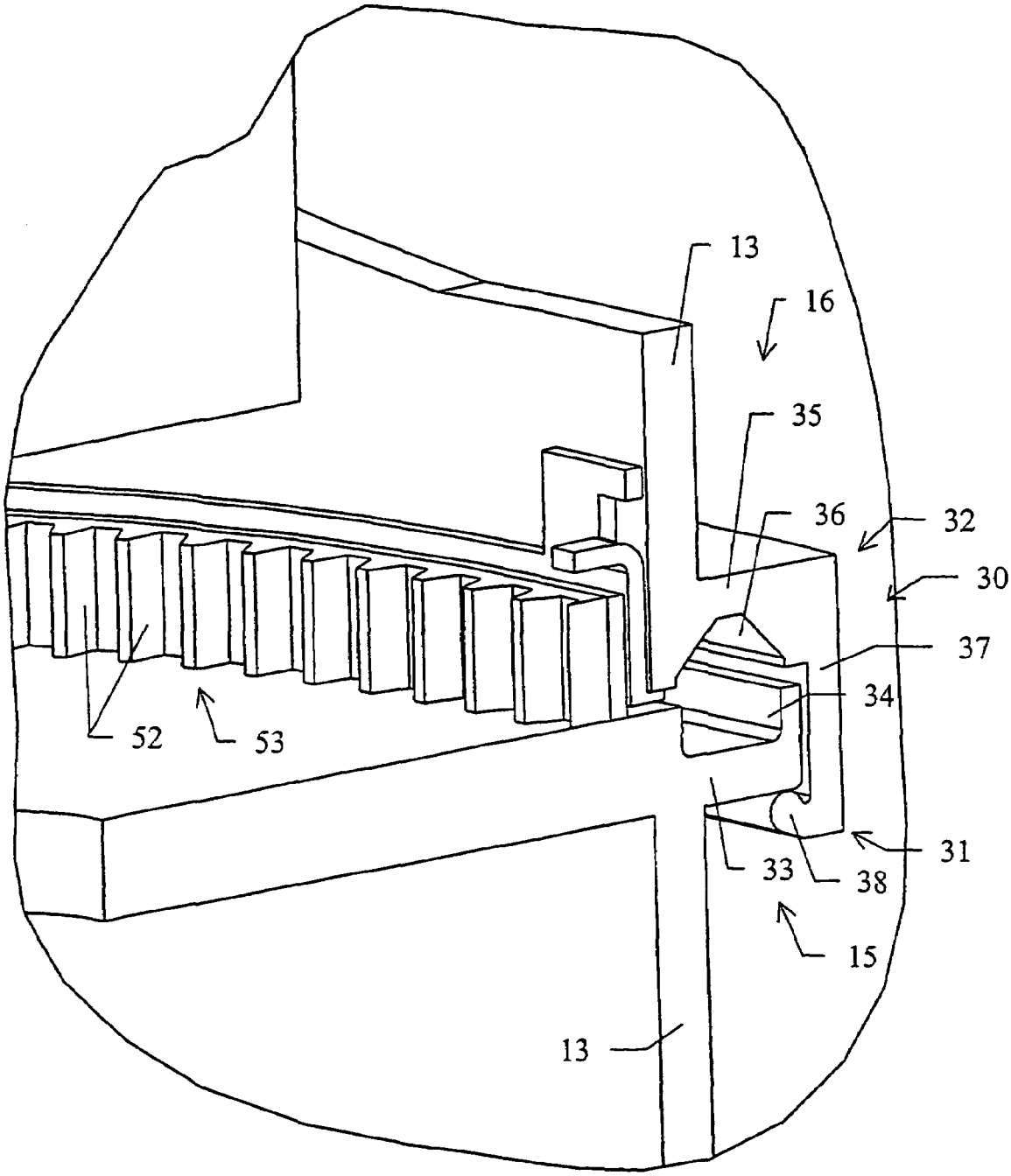
FIG. 3 is a detailed sectioned perspective view of a bearing of the support structure of FIG. 1.

Referring to FIGS. 1 to 3, a first example of a support structure 10 for supporting a plurality of antennas 11 is shown. The support structure 10 is in use typically associated with a node of a mesh communications system as described above and further below in which a plurality of nodes are interconnected using a plurality of point-to-point wireless links.

In the example shown, the support structure 10 is generally columnar. Each antenna 11 of this example is suitable for the transmission and reception of radio or higher frequencies, typically at 1 GHz or higher frequencies, such as 2.4 GHz, 4 GHZ, 28 GHz, 40 GHz, 60 GHz or even 200 GHZ; beyond radio frequencies, other yet higher frequencies such as of the order of 100,000 GHz (infra-red) could be used. Each antenna 11 faces away from the central longitudinal axis 12 of the support structure 10. Each antenna 11 in this example is elliptical in shape and is arranged with its minor axis parallel to the central longitudinal axis 12 of the support structure 10 and with its major axis at a right angle thereto. In use, the support structure 10 will normally be orientated vertically so that its central longitudinal axis 12 is vertical and each antenna 11 is therefore normally arranged to transmit and receive in a direction that is substantially centred in elevation on the horizontal plane, i.e. typically within about ±5° of the horizontal plane.

Each antenna 11 is mounted in its own antenna support 13. In the example shown, there are four antenna supports 13 each for supporting a respective antenna 11. For economy of manufacture, it is preferred that all antenna supports 13 be substantially identical (i.e. constructionally and/or functionally the same as each other except for minor or inconsequential differences, including those that might arise through variations in the manufacturing process).

Each antenna support 13 of this example is generally in the form of a hollow cylinder of circular cross-section. Each antenna support 13 is able to rotate about an axis of rotation 14 which passes between a first or upper end 15 and a second or lower end 16 of the antenna support 13. The cylindrical side wall 17 of each antenna support 13 is recessed on one side to receive an antenna 11 and is provided with screw fixing holes 18 which can receive screws for fixing the antenna 11 to the antenna support 13. In this example, an external radome 20 surrounds the antenna supports 13.

For simplicity of manufacture of various components and in order to keep down the number of rotatable waveguide couplings (discussed further below), it is preferred that the axes of rotation 14 of all of the rotatable antenna supports 13 be coincident with each other and further it is preferred that the axes of rotation 14 of all of the rotatable antenna supports 13 be coincident with the central longitudinal axis 12 of the support structure 10.

The antenna supports 13 are stacked vertically end-to-end so that a first end is of one antenna support 13 opposes the second end 16 of a neighbouring antenna support 13. The second or lower end 16 of the lowermost antenna support 13 opposes a cylindrical base unit 19 which in use is stationary and typically fixed to a subscriber's premises. In the example shown in FIGS. 1 to 3, neighbouring antenna supports 13 are connected together via a bearing 30 which is provided at the junction between the neighbouring antenna supports 13 and which allows the neighbouring antenna supports 13 to rotate relative to each other. A similar bearing 30 is provided at the connection between the lowermost antenna support 13 and the base unit 19 to allow the lowermost antenna support 13 to rotate relative to the base unit 19.

The bearing 30 between neighbouring antenna supports 13 includes a first bearing half 31 formed at the first or upper end 15 of the lowermost antenna support 13 and a second bearing half 32 formed at the lower or second end 16 of the upper antenna support 13. The lower bearing half 31 is provided by a radially outwardly projecting flange 33 having an annular groove 34 in its upper surface.

Similarly, the upper bearing half 32 is provided by a radially outwardly projecting flange 35 having a generally V-shape annular groove 36 which opposes the annular groove 34 of the lower bearing half 31. The opposed annular grooves 34,36 provide a channel which receives ball bearings (not shown) and allow the antenna supports 13 to rotate relative to each other. A similar arrangement can be provided for the bearing 30 between the lowermost antenna support 13 of the support structure 10 and the base unit 19.

In the example shown, the radial flange 35 at the second or lower end 16 of each antenna support 13 has plural discrete depending legs 37 each of which is provided at its free end with an inwardly facing bead 38. The beads 38 fit under the adjacent radial flange 33 at the first or upper end 15 of the neighbouring antenna support 13, or under a corresponding structure of the base unit 19 for the lowermost antenna support 13, to enable the antenna supports 13 and the base unit 19 to be simply but securely clipped together.

Whilst the bearings 30 for the antenna supports 13 in the example shown in FIGS. 1 to 3 are provided by cooperating bearing halves 31,32 on neighbouring antenna supports 13 and the lowermost antenna support 13 and the base unit 19 respectively, the bearings could be provided by other arrangements. For example, the entirety of the bearings 30 may be provided by a discrete component provided separately of the antenna supports 13. In another alternative arrangement, the bearing 30 for any particular antenna support 13 may be provided between that antenna support 13 and the external radome 20 or another external structure such that the antenna support 13 is rotatably supported by the radome 20 or other external structure.

In any of these arrangements, the bearings 30 allow entirely free rotation between neighbouring antenna supports 13 and between the lowermost antenna support 13 and the base unit 19. However, it may be desirable to limit the amount of rotation of one antenna support 13 relative to its neighbouring antenna support or supports 13, for example to prevent cabling within the support structure 10 from being overwound or becoming entangled. In order to allow full 360° rotation of any one antenna support 13, neighbouring antenna supports 13 should be allowed to rotate to 720° or preferably just over 720° relative to each other.

In order to enable one antenna support 13 to be rotated relative to a neighbouring antenna support 13, a drive arrangement, for example an electric motor 50, is fixed to the inside of each antenna support 13 towards it second or lower end 16. Other drive arrangements, particularly those which provide a stepped action, are possible, including for example hydraulic, pneumatic, or ratchet type arrangements. The motor 50 has a gear wheel 51 which engages the inwardly facing teeth 52 of a ring gear 53 of a neighbouring antenna support 13, a ring gear 53 being provided at the first or upper end 15 of each antenna support 13. When the electric motor 50 is operated to rotate the gear wheel 51, the engagement between the gear wheel 51 and the ring gear 53 causes the antenna supports 13 to rotate relative to each other. The electric motors 50 are preferably stepper motors in order to provide for fine and sensitive control of the movement of the antenna supports 13. As will be appreciated, the lowermost of neighbouring antenna supports 13 will stay relatively stationary whilst the upper of the neighbouring antenna supports 13 will rotate under the action of the motor 50 in that upper antenna support 13. A corresponding motor and ring gear arrangement (not shown) is provided between the lowermost antenna support 13 and the base unit 19 in order to enable that lowermost antenna support 13 to be rotated relative to the base unit 19.

Whilst the antenna supports 13 of the example shown in FIGS. 1 to 3 are rotated by engagement of a motor 50 on one antenna support with a ring gear 53 on an immediately lower antenna support 13 or base unit 19, in the case where an external radome 20 or other external structure is provided, the antenna supports 13 can instead be rotated by having a rotation device, such as a motor, acting between each antenna support 13 and the radome 20 or other external structure rather than between adjacent antenna supports 13/base unit 19 as in the example described above.

The support structure 10 described above allows fully independent rotation of each antenna support 13 over at least a full 360° travel about its axis of rotation 14. This allows each antenna 11 to be pointed in any direction in azimuth. It will be understood that if for example it is desired to rotate any particular antenna support 13 but leave the antenna supports 13 above that antenna support 13 in their current positions, then in the arrangement shown in FIGS. 1 to 3 in which rotation is caused by forces acting between adjacent antenna supports 13 or the lowermost antenna support 13 and the base unit 19 (rather than for example because of forces acting against the external radome 20), then if one antenna support 13 is rotated through a certain rotational angle, it is necessary to cause the antenna support 13 immediately above that antenna support 13 to rotate in the opposite direction through the same angle. In other words, when one antenna support 13 is rotated, it will normally be necessary to rotate the antenna support 13 immediately above that first antenna support 13 back to its original position in order to maintain all of the antenna supports 13 other than the one antenna support 13 in their original positions. In the preferred implementation, the control system for rotating the antenna supports 13 is arranged so as to automatically provide an exactly equal and opposite rotation to the antenna support 13 above the antenna support 13 being rotated. This can simply be achieved by connecting the motors 50 of adjacent antenna supports 13 in series and anti-phase.

All of the above described rotations of the antenna supports 13 can be achieved autonomously or at least semi-autonomously under the control of a suitably programmed controller associated with the support structure 10.

This can for example be achieved remotely under operator control or by causing the antenna supports 13 each to rotate until a strong signal from an appropriate node is received at each antenna 11 thus allowing the antennas 11 to "hunt" around for other appropriately positioned nodes.

In the example shown in FIGS. 1 to 3, a single transceiver unit 60 is contained in every other antenna support 13, though other arrangements, such as a single transceiver unit for all of the antennas, are feasible. Typically, the transceiver units 60 will be radio modules. The transceiver units 60 contain all of the necessary circuitry to allow signals to be transmitted and received via the antennas 11. Each transceiver unit 60 services the antenna 11 provided in the same antenna support 13 as well as the antenna 11 provided in a neighbouring antenna support 13 (in the example shown, the lower neighbouring antenna support 13). In the example shown in which the wireless transmissions to and from the antennas 11 are at microwave frequencies (approximately 1 GHz or higher), waveguides 100 are provided to connect the radio module 60 to the respective antennas 11.

The arrangement described above leaves clear the central longitudinal axis 12 of the support structure 10 and the axes of rotation 14 of the antenna supports 13 as all bearing and rotator components are provided away from the central longitudinal axis 12 of the support structure 10 and the axes of rotation 14 of the antenna supports 13. This allows the waveguides 100 or other antenna feeds to pass in part along the central longitudinal axis 12 of the support structure 10 and the axes of rotation 14 of the antenna supports 13.

Figure 4:
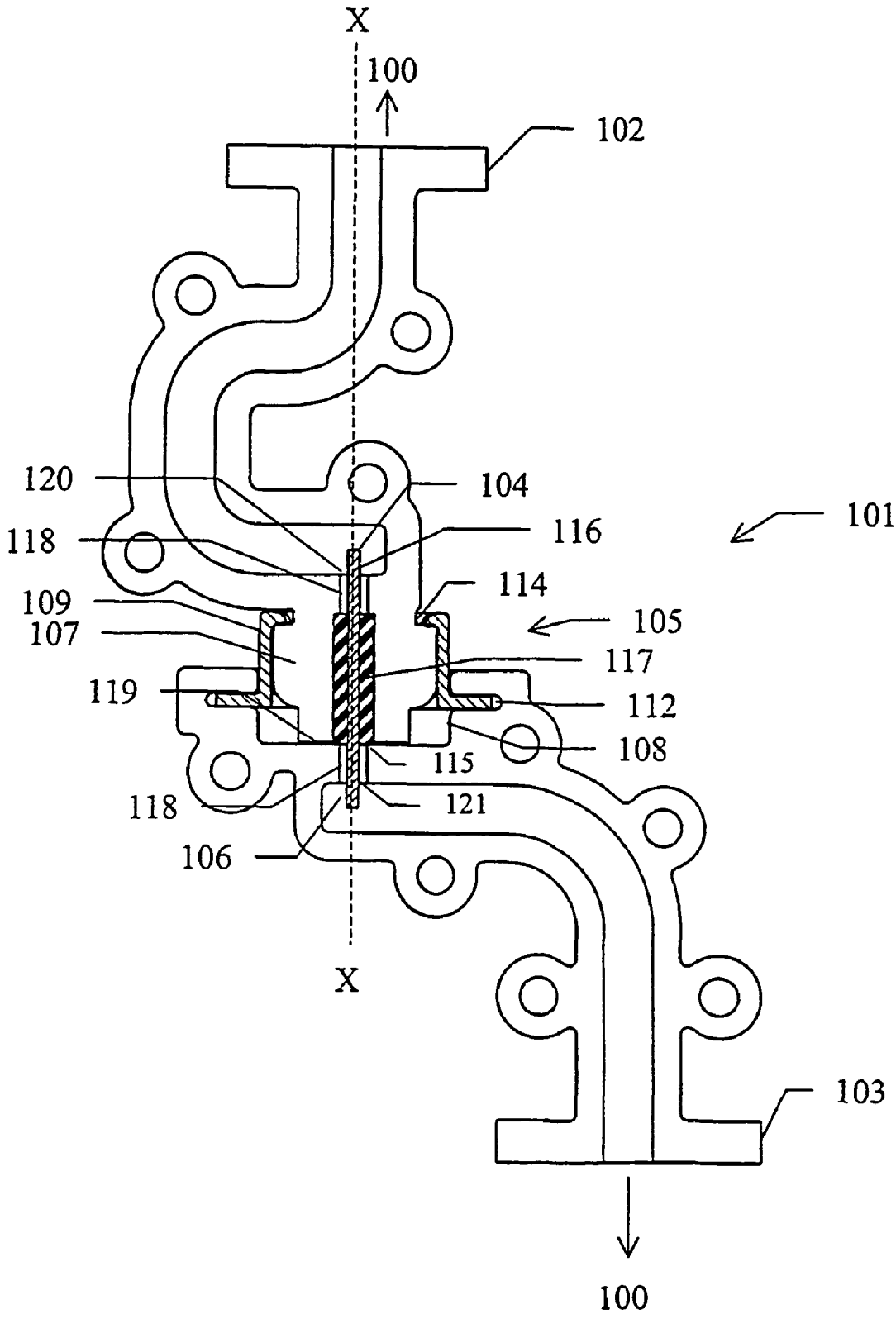
FIG. 4 is a longitudinally sectioned elevation of an example of a rotary coupling according to the present invention.
Figure 5:
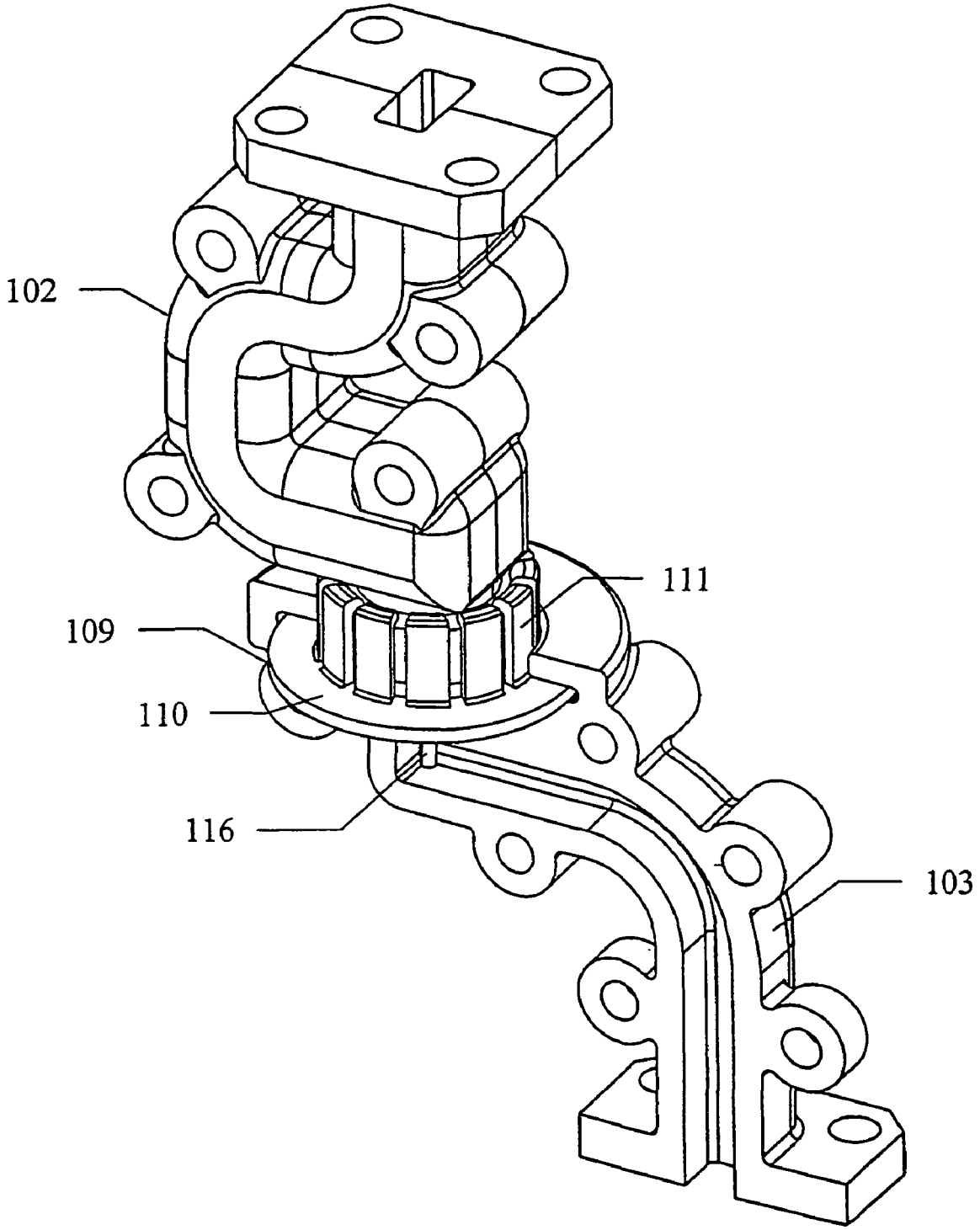
FIG. 5 is a partial perspective view of the rotary coupling of FIG. 4.
Figure 6:
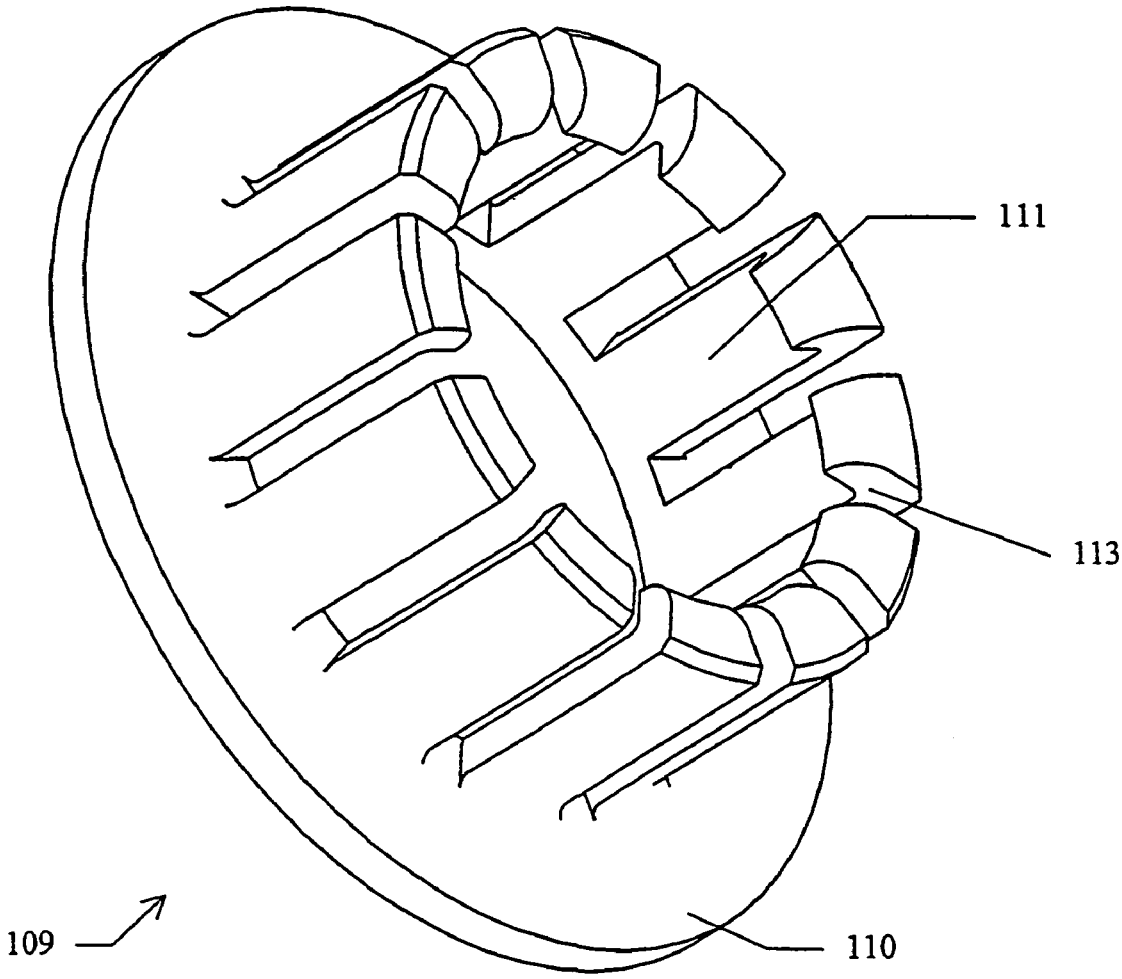
FIG. 6 is a perspective view of a clip of the rotary coupling of FIG. 4.

Referring now to FIGS. 4 to 6, there is shown an example of a rotary coupling 101. The rotary coupling 101 has particular application in connecting a waveguide 100 in one antenna support 13 to a waveguide 100 in an adjacent antenna support 13 in the example of a support structure 10 described above, though the rotary coupling 101 may be used in other applications. The axis of rotation X of the coupling 101 is along the axis of rotation 12 of the antenna supports 13. A first or upper waveguide section 102 of the rotary coupling 101 is connected to the waveguide 100 in the upper antenna support 13 which in turn is connected to a transceiver unit 60 in the upper antenna support 13. A second waveguide section 103 of the rotary coupling 101 is connected to the waveguide 100 in the lower antenna support 13 which in turn is connected to an antenna 11 in the lower antenna support 13. A first waveguide transition 104 associated with the first waveguide section 102 converts a waveguide transmission in the first waveguide section 102 into a coaxial transmission and vice versa. A coaxial transmission section 105 transmits the coaxial transmission. As will be understood, the coaxial transmission section 105 has an axially symmetric transmission pattern. A second waveguide transition 106 associated with the second waveguide section 103 converts a waveguide transmission in the second waveguide section 103 into a coaxial transmission and vice versa.

An outer conductor of the coaxial transmission section 105 is provided by a nose 107 of the first waveguide section 102. The nose 107 is directed along the axis of rotation X of the coupling 101 and is received in a recess 108 in the second waveguide section 103. A resilient clip 109, which may be plastics, holds the nose 107 in the recess 108 to secure the first and second waveguide sections 102,103 together. The clip 109, shown separately in FIG. 5, is generally cylindrical and has an annular flange 110 projecting radially outwards and plural depending legs 111. In the assembled rotary coupling 101, the annular flange 110 is received in an annular slot 112 in the recess 108 to secure the clip 109 in the second waveguide section 103 and the legs 111 surround the nose 107 of the first waveguide section 102. Inwardly facing projections 113 at the free ends of the legs 111 engage in an annular recess 114 behind the nose 107 to secure the first and second waveguide sections 102,103 together.

The nose 107 of the first waveguide section 102 has a central shouldered through bore 115 which in use receives a pin 116 which acts as the central conductor of the coaxial transmission section 105. An insulating sleeve 117, which is preferably of a low loss dielectric material, such as PTFE, surrounds most of the pin 116 in the nose 107 to provide the central portion of the coaxial transmission section. Air gaps 118 between the pin 116 and the first and second waveguide sections 102,103 are used to form the coaxial transmission sections above and below the insulating sleeve 117. As can be seen, the shouldered through bore 115 of the first waveguide section 102 and the abutting surface of the second waveguide section 103 hold the insulating sleeve 117 in place. The dimensions of the pin 116, the insulating sleeve 117, and the air gaps 118 are selected to provide electrical matching of the transmission impedance between the waveguide transitions 104,106 and the coaxial transmission section 105 at the frequency of operation and to reduce transmission losses and reflections. Similarly, the thickness of the outer conductor at the end of the nose 107 (i.e. the radial depth of the joint) is preferably selected to correspond to a distance of a quarter wavelength in the radial transmission mode at the frequencies of operation to restrict the leakage of electromagnetic radiation through the joint and to reduce transmission losses and reflections.

The end of the nose 107 and the abutting surface of the second waveguide section 103 form an electrical connection in the outer conductor of the coaxial transmission section when the joint is assembled. In an alternative arrangement, a thin insulating washer 119, which is preferably of a low loss dielectric material, or an air gap, can be provided between the end of the nose 107 and the abutting surface of the second waveguide section 103 to create an electrically insulated contact. Conveniently, the washer 119 is made of a material that also has low friction, such as PTFE.

The first waveguide section 102 is formed in two halves which can be fixed together by some suitable means such as screws, adhesive or the like. The hollow interior of the first waveguide section 102 provides a waveguide cavity of rectangular section. The first waveguide section 102 is shaped so that a broad side of the waveguide cavity is directed initially from its end adjacent the connected waveguide 100 to lie parallel to the axis of rotation X, and then via a generally U shape bend in the first waveguide section 102 to be perpendicular, then parallel, and then perpendicular again to the axis of rotation X at its second end adjacent the nose 107. In the assembled rotary coupling 101, the pin 116 extends through a small circular hole 120 in the wall of the first waveguide section 102 into the cavity of the first waveguide section 102.

The second waveguide section 103 is similarly formed in two halves which can be fixed together by suitable means such as screws, adhesive or the like. The hollow interior of the second waveguide section 103 provides a waveguide cavity of rectangular section. The second waveguide section 103 is shaped so that a broad side of the waveguide cavity is directed initially from its end adjacent the connected waveguide 100 to lie parallel to the axis of rotation X and then perpendicular to the axis of rotation X at its second end adjacent the recess 108 that receives the nose 107 of the first waveguide section 102. In the assembled rotary coupling 101, the pin 116 extends through a small circular hole 121 in the wall of the second waveguide section 103 into the cavity of the second waveguide section 103.

To assemble two neighbouring antenna supports 13, the two halves of the first waveguide section 102 are fixed together with the pin 116 and insulating sleeve 117 in position in the nose 107. The assembled first waveguide section 102 is then attached to a waveguide 100 in the upper antenna support 13 (which is connected in this example to a transceiver module 60 in the upper antenna support 13). The two halves of the second waveguide section 103 are similarly fixed together with the annular flange 110 of the clip 109 held in the annular slot 112. The assembled second waveguide section 103 is then attached to a waveguide 100 in the lower antenna support 13 (which in this example is connected to an antenna 11 in the lower antenna support 13). The two antenna supports 13 are then brought together which brings together the first and second waveguide sections 102,103 of the rotary coupling 101. During this bringing together, the legs 111 of the clip 109 spread over the nose 107 until the inwardly facing projections 113 drop into place in the recess 114 behind the nose 107, thus securing the first and second waveguide sections 102,103 together. If required, the rotary coupling 101 can be disassembled by applying modest force to separate the inwardly facing projections 111 from the recess 114. The clip 109 thus allows the first and second waveguide sections 102,103 to be easily connected and, if necessary, disconnected.

It will be appreciated by those skilled in the art that when transmitting microwave or similar frequencies in a coaxial transmission section 105 such as that described above, the electromagnetic fields are circularly symmetric about the coaxial axis (the axis parallel to both the inner conductor 116 and the outer conductor 107). This property allows the coaxial transmission section 105 to rotate about the axis of rotation of the rotary coupling 101 without affecting the efficiency of the transmission. Moreover, the arrangement described above ensures that the coaxial transmission section 105 is as short as possible, thereby minimising transmission losses.

It will be understood that transmissions can be carried either from the first waveguide section 102 through to the second waveguide section 103 or vice versa, according to whether the antenna 11 to which the second waveguide section 103 is connected is receiving or transmitting.

The arrangement described above and shown with particular reference to FIGS. 1 to 3, optionally in conjunction with the rotary coupling 101 of FIGS. 4 to 6, enables an antenna 11 in one antenna support 13 and an antenna 11 in a neighbouring antenna support 13 to share a single radio module or transceiver unit 60 whilst still allowing those two antenna supports 13 to rotate with respect to each other and requiring only a maximum of a single rotatable coupling in any connection between the transceiver unit 60 and an antenna 11. Alternative arrangements for the support structure are possible.

Figure 7:
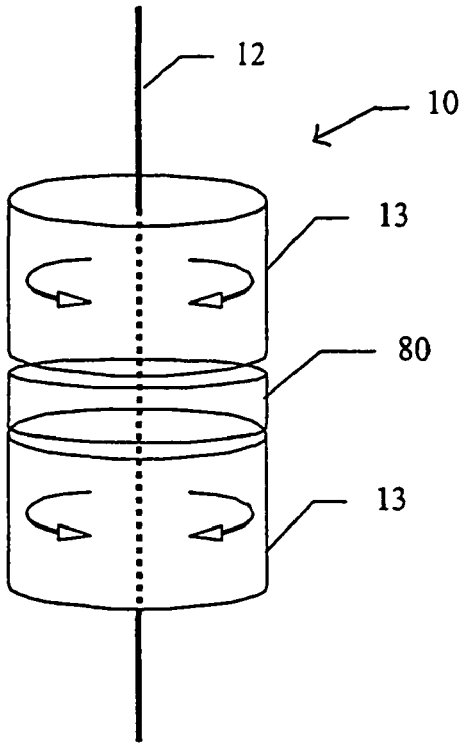
FIGS. 7 and 8 are respectively a schematic perspective view and a schematic longitudinally sectioned elevation of another example of a support structure according to the present invention.
Figure 8:
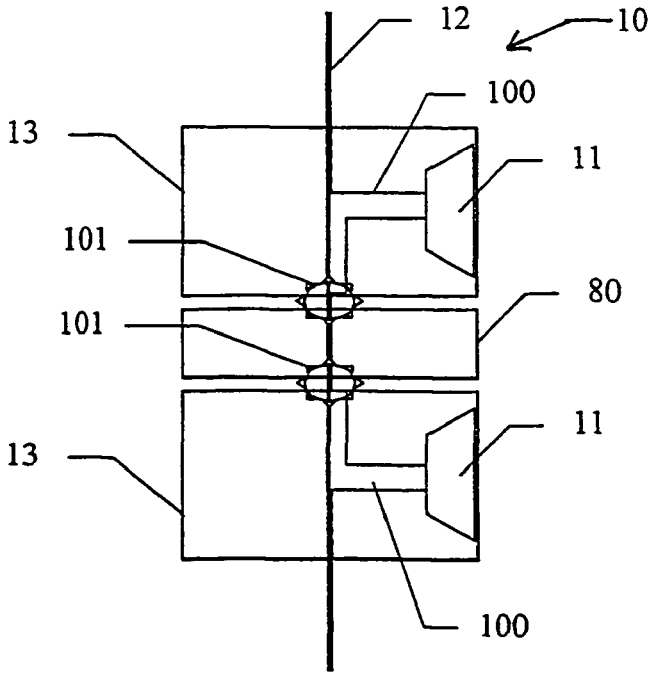

For example, referring to FIGS. 7 and 8, there is shown a second example of a support structure 10. Elements having generally the same or corresponding structure and function as elements described above have the same reference numerals and will not be further described.

In the example of FIGS. 7 and 8, an antenna support 13 is provided on each side of a dedicated transceiver support 80 which is provided as a separate component coaxial with the antenna supports 13. The transceiver support 80 contains a common transceiver unit 60 which is connected by respective waveguides 100 to both of the antennas 11. To enable the antenna supports 13 to rotate relative to the transceiver support 80, respective rotatable couplings 101 are provided between the waveguides 100 and the common transceiver unit 60 in the transceiver support 80. It will be understood that whilst not shown in the drawings, bearings and apparatus for rotating the antenna supports 13 are provided, in each case either between the antenna supports 13 and the transceiver support 80 or between the antenna supports 13 and an external radome or other external structure, as discussed above.

Figure 9:
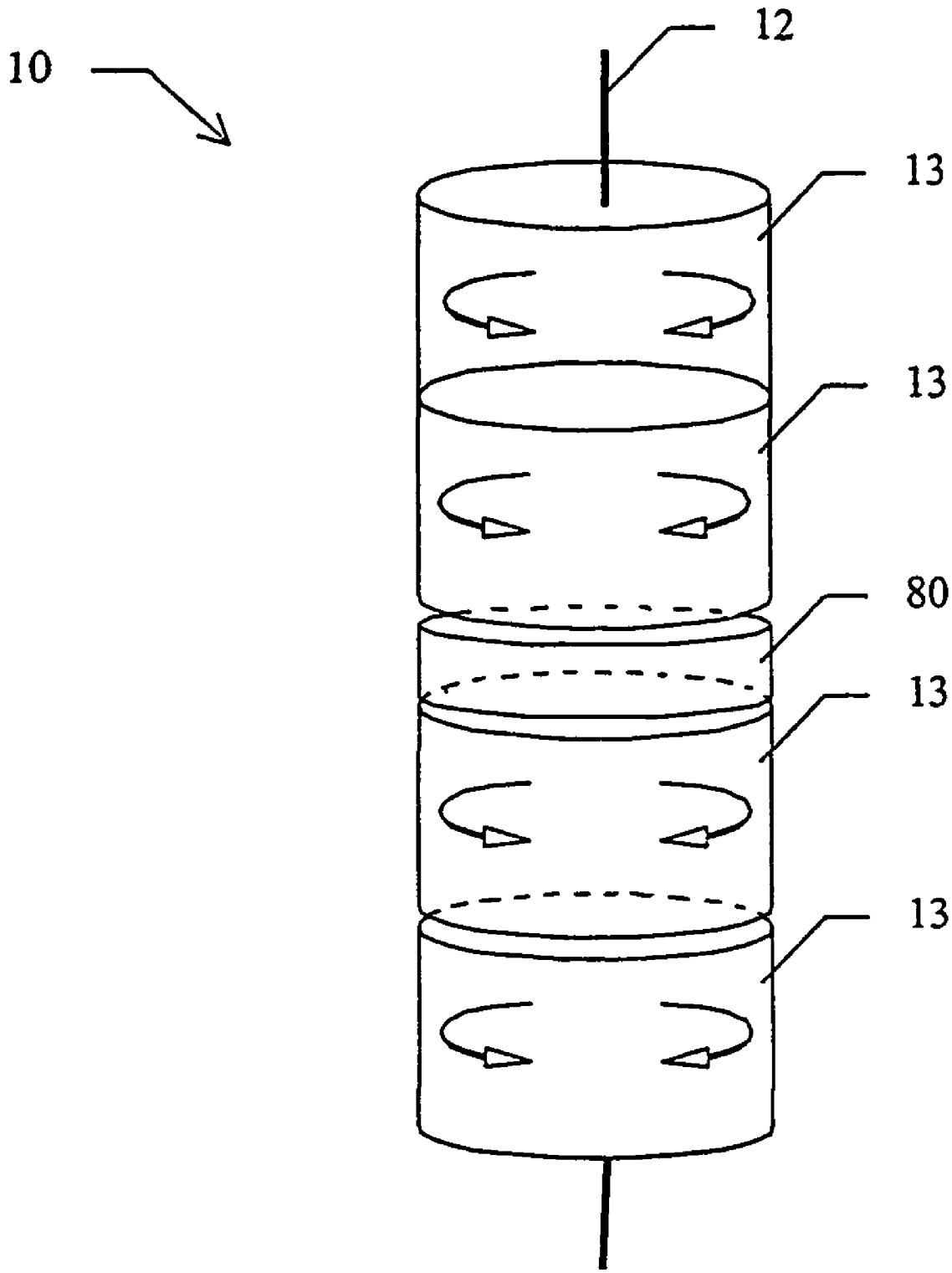
FIGS. 9 and 10 are respectively a schematic perspective view and a schematic longitudinally sectioned elevation of another example of a support structure according to the present invention.
Figure 10:
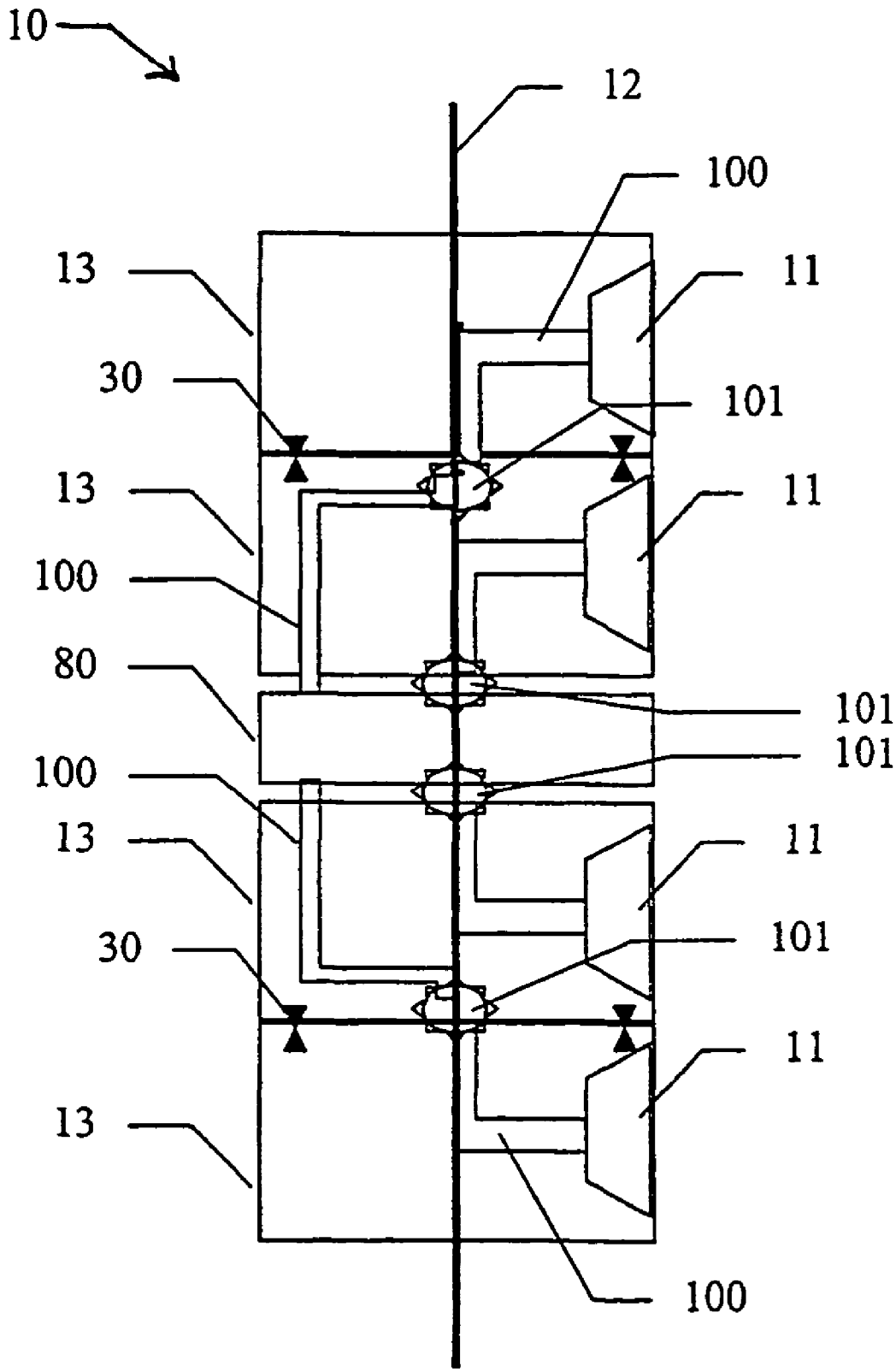

A third example of a support structure 10 is shown in FIGS. 9 and 10. Again, elements having generally the same or corresponding structure and function as elements described above have the same reference numerals and will not be further described. In the third example, the apparatus of FIGS. 7 and 8 is in effect extended by adding a further antenna support 13 at each end. In the example shown in FIGS. 9 and 10, annular bearings 30 are provided between these outer antenna supports 13 and the inner antenna supports 13.

A single common transceiver unit 60 services all of the antennas 11 in this example. The connection between the common transceiver unit 60 and the innermost antennas 11 can be as for the second example described above with reference to FIGS. 7 and 8. For the connection between the common transceiver unit 60 and the outermost antennas 11, further waveguides 100 pass from the common transceiver unit 60 through the innermost antenna supports 13 to respective rotatable couplings 101 provided at the boundary between the innermost and outermost antenna supports 13. Further respective waveguides 10 in the outermost antenna supports 13 pass between the rotatable couplings 101 and the antennas 11 in the outermost antenna supports 13.

As a refinement to the examples shown in FIGS. 1 to 10, electromagnetic radiation absorbing material, such as carbon loaded plastics, can be incorporated into the material of some or all of the antenna supports 13 to absorb unwanted electromagnetic radiation from the antennas 11 and/or the transceiver units 60. As another example, reflective material, such as metal-coated plastics, can be used for the material of some or all of the antenna supports 13 to provide electromagnetic screening of the contents of the antenna supports 13. It will be understood by those skilled in the art that by incorporating absorbing or reflecting materials into the rotating antenna support 13, the absorbing/reflecting properties affect the electromagnetic radiation pattern in a constant manner regardless of the angular position of the antenna 11, thereby ensuring that the electromagnetic properties are largely independent of the direction of the antenna 11.

Another example of a refinement is to construct the cylindrical side wall 17 of each antenna support 13 such that it provides environmental protection from for example rain, snow and the like. This may be achieved by using water resistant materials for the construction of the cylindrical side wall 17 and by providing watertight seals between the antenna supports 13.

It will be appreciated that any of the environmental protection, electromagnetic radiation reflection and electromagnetic radiation absorption features may be provided. The provision of environmental protection, electromagnetic radiation reflection and/or electromagnetic radiation absorption features into the antenna supports 13 themselves means that an external radome 20 is not required as the antenna supports 13 can in effect provide their own radome. It will be appreciated by those skilled in that art that an external radome 20 can reduce the wanted electromagnetic signal by placing additional materials in front of the antenna 11 and so the omission of an external radome 20 can result in overall lower signal losses.

Figure 11:
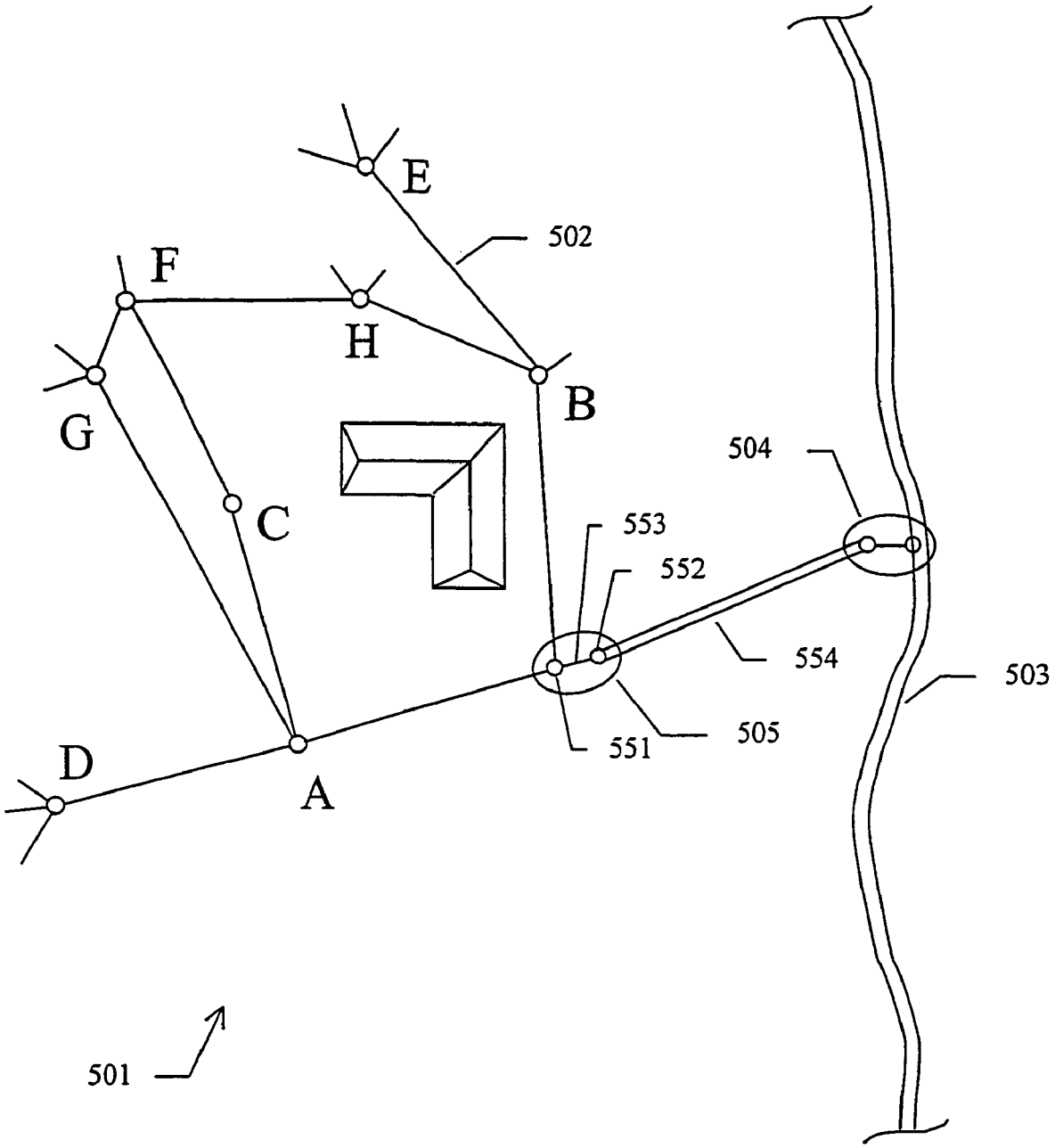
FIG. 11 is a schematic representation of a portion of a mesh communications network.

Referring now to FIG. 11, there is shown schematically an example of a communications network 501 as described above and in which the apparatus described above can be used. The network 501 has plural nodes A–H (only eight being shown in FIG. 11) which are logically and physically connected to each other by respective point-to-point data transmission links 502 between pairs of nodes A–H in order to provide a mesh of interconnected nodes. The links 502 between the nodes A–H are provided by substantially unidirectional (i.e. highly directional) radio transmissions, i.e. each signal is not broadcast but is instead directed to a particular node, with signals being capable of being passed in both directions along the link 502. The transmission frequency will typically be at least 1 GHz and may be for example 2.4 GHz, 4 GHz, 28 GHz, 40 GHz, 60 GHz or even 200 GHz. Beyond radio frequencies, other yet higher frequencies such as of the order of 100,000 GHz (infra-red) could be used.

Each node A–H has plural antennas which provide for the potential point-to-point transmission links to other nodes. In a typical example, each node A–H has four antennas and so can be connected to up to four or more other nodes. In the example shown schematically in FIG. 11, the mesh 501 of interconnected nodes A–H is connected to a trunk 503. The point at which data traffic passes from the trunk 503 is referred to herein as a trunk network connection point ("TNCP") 504. The connection between the TNCP 504 and the mesh network 1 will typically be via a mesh insertion point ("MIP") 505. The MIP 505 will typically consist of a standard node 551 which has the same physical construction as the nodes A–H of the mesh network 501 and which is connected to a specially adapted node 552 via a feeder link 553. The specially adapted node 552 provides for a high data transfer rate connection via suitable (radio) links 554 to the TNCP 504 which, in turn, has suitable equipment for transmitting and receiving at these high data transfer rates.

The antennas at each node in the communications network 501 can be mounted in a support structure or transceiver apparatus as described above. It may be convenient to use one particular type of support structure or transceiver apparatus for some nodes whilst using different types of support structure or transceiver apparatus for other nodes depending for example on the physical or geographical location of the individual nodes.

As described in our copending International patent application no. (agent's ref P8220WO), the beam transmitted by each antenna 11 may be asymmetric and in particular is preferably narrower in azimuth than in elevation. This is indicated schematically in FIGS. 13A and 13B in which there is shown a transmitted beam 400 having a beam width 401 in elevation that is greater than its beam width 402 in azimuth. In other words, the angle subtended at the antenna transmitting the beam 400 by the half power points 403,404 of the main lobe 405 of the beam 400 is greater in elevation than in azimuth, as shown by FIGS. 12A and 12B respectively. This has many advantages, especially when used in the context of a mesh communications network which uses a multiplicity of point-to-point wireless transmissions between nodes. It will be understood that in practice, the beam 400 is likely to be transmitted in a horizontal or substantially horizontal direction (i.e. the beam direction is centred in elevation on or substantially on the horizontal plane, i.e. typically within about ±5° of the horizontal plane).

By providing a beam that has a beam width that is narrow in azimuth, the spectral efficiency of the communications network 501 can be increased. This is because, in a typical implementation, the same frequency may be used at plural different spatial locations and this reuse of the same frequency can lead to interference of the wanted signals at a node by unwanted signals from other nodes, the unwanted interference including a multiplicity of interfering transmissions, for example co-channel interference caused by other wireless transmissions that are using the same frequency and adjacent channel interference caused by wireless transmissions using adjacent frequencies. By using asymmetric directional antennas in a mesh system as described above, the aggregate levels of both co-channel interference and adjacent channel interference can be reduced and this allows more reuse of the frequencies for a given level of interference and/or a reduction in the absolute level of interference and/or a reduction in the amount of spectrum required to service a set of users. In general, the spectral efficiency decreases with the square of the beam width in azimuth. Furthermore, given that the node to which transmissions are being directed may be at a different elevation to the node from which transmissions are being sent, having a beam width that is relatively wide in elevation (i.e. a tall beam) means that the beam is more likely to reach the target node without the transmitting antenna having to be steered in elevation. In other words, whilst in practice it may be desirable or even necessary for the antenna of the transmitting node to be steerable in azimuth, the asymmetric beam makes it less likely that the antenna of the transmitting node needs to be steerable in elevation. It will be appreciated that if it is desirable or necessary for the antenna of the transmitting node to be steerable in azimuth, then said antenna can be mechanically steerable or electronically steerable or both, possibly with mechanical steering being used for coarse steering and electronic steering being used for fine steering once the antenna is directed in approximately the correct direction. Similar considerations apply for the antenna at the receiving node.

A further advantage of the asymmetric beam is that it can reduce the effect of wind loading on the antenna, which can be important in practice in those implementations in which the antenna apparatus is mounted outdoors. For example, for an antenna mounted on a pole or the like, the effect of wind loading is typically to bend the pole to cause the antenna supports to tilt away from the horizontal plane. This movement of the antenna can lead to significant depointing in the elevation plane, while producing no or less depointing in the azimuth plane. Having a beam width that is greater in elevation means that the antenna apparatus is less sensitive to the depointing effects of wind loading.

A yet further advantage of the asymmetric beam is its effect on the overall height of the antenna apparatus. In particular, to produce a beam that has a beam width that is narrower in azimuth than in elevation, the antenna will typically be relatively short from top to bottom (to produce a relatively large beam width in elevation) and relatively wide from side to side (to produce a relatively narrow beam in azimuth). This means that the overall height of the antenna apparatus can be less for corresponding frequencies and antenna gain than if for example a symmetrical beam were used. It will be understood that planning regulations and also aesthetics may mean that a relatively short antenna apparatus is highly desirable.

Moreover, for a given size of antenna, higher gain and directivity (i.e. reduced beam width) can be achieved by increasing the frequency. In the typical implementation, where the antenna apparatus is associated with a node in a mesh communications system of the type described above, this effect can be used to compensate for the increased path loss that occurs for wireless transmission links that are operating at higher frequencies. For example, if a node is redesigned to operate at a higher frequency while keeping the overall dimensions of the antenna the same, then the antenna can be designed to provide a higher gain (for said given dimensions) and this can compensate for the increased path loss when operating at said higher frequencies.

Figure 13A:
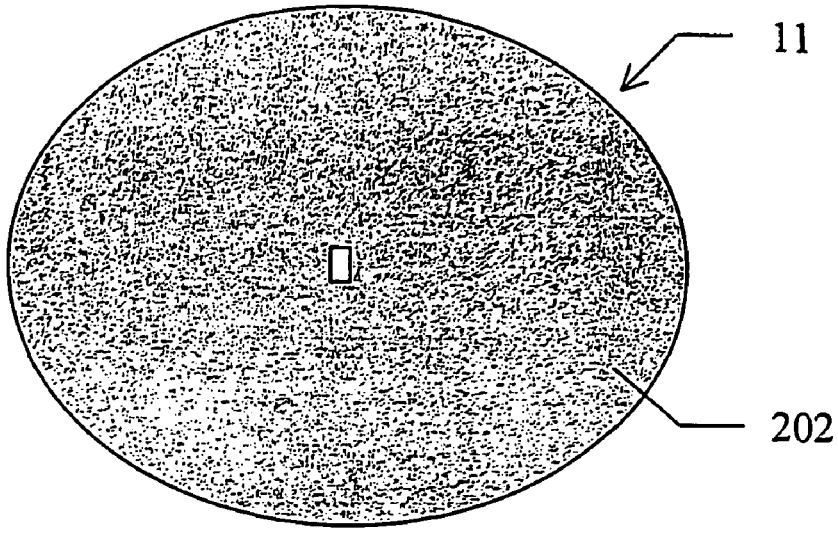
Figure 13B:
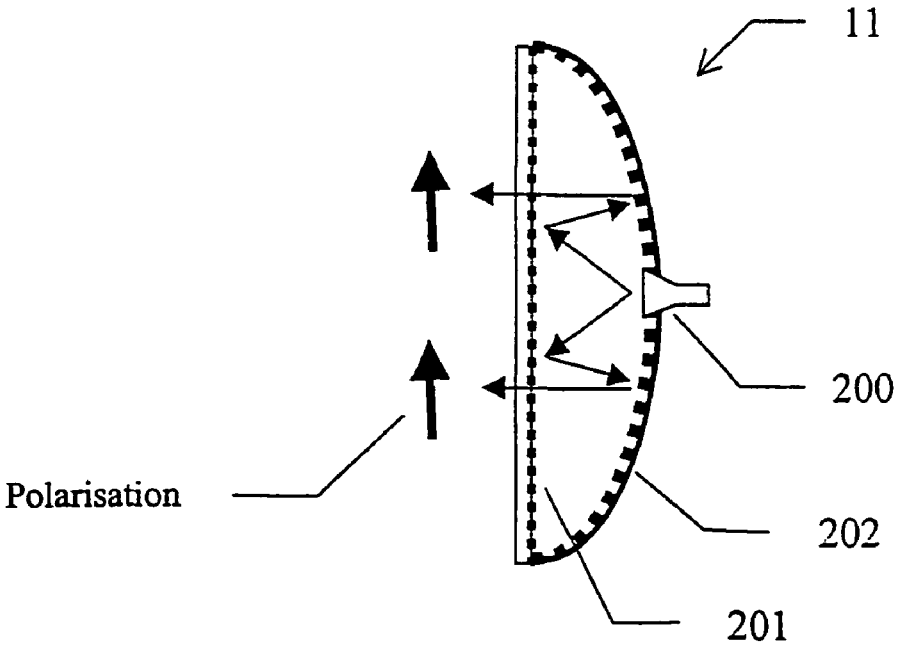

Referring now to FIGS. 13A and 13B, a preferred antenna 11 is shown, which is known as a twist reflector antenna. A linearly polarised feed horn 200 illuminates a polarisation-sensitive flat sub-reflector 201 as shown by arrows that show the direction of propagation of the TEM wave. The energy is reflected by the sub-reflector 201 onto a parabolic corrugated main reflector 202. The corrugations of the main reflector 202 are arranged so as to twist the polarisation of the beam through 90° on reflection. By virtue of this twist of the polarisation, when the energy again impinges on the flat sub-reflector 201, it passes through into the far field. It should be noted that the corrugations of the main reflector 202 are arranged so as to create a precise phase shift which affects the polarisation twist on reflection, the phase shift being frequency dependent. Similarly, the thickness of the sub-reflector 201 is in general chosen such that reflection from its innermost and outermost surfaces are cancelled, which is again a frequency-dependent effect.

The basic antenna described briefly above is described more fully in WO-A-98/49750, the entire content of which is incorporated herein by reference. However, because as discussed above it is preferred that the beam transmitted by the antenna 11 be asymmetric and particularly that it be narrower in azimuth than it is tall in elevation, the main reflector 202 and correspondingly the sub-reflector 201 in the preferred embodiment are elliptical and arranged with their minor axes vertical.

In a mesh communications network as described above, the nodes are typically arranged so that wireless transmissions between the nodes take place at a frequency in the range 1 GHz to 100 GHZ. Specific preferred frequencies are in the range about 24 GHz to about 30 GHz or in the range about 40 GHz to about 44 GHz. For frequencies in the range about 24 GHz to about 30 GHz, a beam width in azimuth in the range 5° to 7° and a beam width in elevation in the range 9° to 12° is preferred. For frequencies in the range about 40 GHz to about 44 GHz, a beam width in azimuth in the range 3.5° to 5° and a beam width in elevation in the range 6.5° to 9.5° is preferred. In general, as the frequency increases, the beam width in both azimuth and elevation decreases. In general, it is preferred that the beam width in azimuth be less than about 9° and the beam width in elevation be less than about 15°.

Embodiments of the present invention have been described with particular reference to the examples illustrated. However, it will be appreciated that variations and modifications may be made to the examples described within the scope of the present invention. For example, the support structures 10 of any of the examples described above can be extended by adding further antenna supports 13. Instead of waveguides, other means for conveying signals between the transceiver units and the antennas may be provided, depending on the frequency of transmission.

The invention claimed is:

1. A support structure for supporting a plurality of antennas, the support structure comprising:

a plurality of antenna supports each for supporting at least one antenna, each antenna support having first and second ends;

each antenna support being supported for rotation about an axis of rotation between the first and second ends;

at least one antenna support being selectively rotatable with respect to at least one other antenna support included in the plurality of antenna supports by a rotation device such that an antenna supported by said at least one antenna support rotates therewith, the rotation device comprises a motor fixed to one of said antenna supports and a ring gear on an adjacent antenna support that is drivingly engageable by the motor to cause rotation of one of said antenna supports relative to the other.

2. A support structure according to claim 1, wherein at least two antenna supports are arranged end-to-end such that a first end of one of said antenna supports opposes a second end of the other of said antenna supports.

3. A support structure according to claim 1, comprising a plurality of rotation devices each for causing rotation of a respective antenna support relative to a neighbouring antenna support.

4. A support structure according to claim 1, wherein a first of said antenna supports has a first end opposing a second end of an adjacent second antenna support and wherein a bearing for the second antenna support comprises a first annular bearing half at said first end of said first antenna support and a second annular bearing half at said second end of said second antenna support.

5. A support structure according to claim 1, wherein each antenna support is rotatable independently of each other antenna support.

6. A support structure according to claim 1, comprising a respective antenna mounted in each antenna support for transmitting and/or receiving wireless signals.

7. A support structure according to claim 1, comprising a respective waveguide along the axis of rotation of each antenna support for guiding electromagnetic waves between an antenna mounted in said antenna support and a transceiver.

8. A support structure according to claim 1, wherein at least two neighbouring antenna supports have coincident axes of rotation, and comprising a transceiver mounted in one of said neighbouring antenna supports, an antenna mounted in the other of said neighbouring antenna supports, a first waveguide and a second waveguide, the first waveguide being connected at a first end to said transceiver and at a second end to a first end of the second waveguide, the second end of the second waveguide being connected to said antenna, the connection between the first and second waveguides being a rotatable coupling that allows the first and second waveguides to rotate relative to each other as said neighbouring antenna supports rotate relative to each other, the rotatable coupling having an axis of rotation that is coincident with the axes of rotation of said neighbouring antenna supports.

9. A support structure according to claim 1, comprising an external radome.

10. A support structure according to claim 1, comprising an external radome, wherein the bearing for at least one antenna support is at least partly provided by the radome.

11. A support structure according to claim 1, wherein at least one of the antenna supports is formed at least partly of opaque material that is opaque to the frequency of transmission of antennas supported by the support structure.

12. A support structure according to claim 1, wherein an endmost of the antenna supports is rotatably mounted on a fixed base of the support structure, and comprising a rotation device for rotating said endmost antenna support relative to the base.

13. A support structure according to claim 1, wherein each antenna support is supported by a bearing that is constructed and arranged so as to leave clear the axis of rotation of each antenna support.

* * * * *